United States Patent [19]

Plewes et al.

[11] 4,428,779

[45] Jan. 31, 1984

[54] HIGH-STRENGTH, HIGH-CONDUCTIVITY COPPER ALLOYS

[75] Inventors: John T. Plewes, Chatham; Robert W. Tomb, Ringoes, both of N.J.

[73] Assignee: Bell Telephone Laboratories, Incorporated, Murray Hill, N.J.

[21] Appl. No.: 393,691

[22] Filed: Jun. 30, 1982

[51] Int. Cl.[3] ..... C22F 1/08; C22C 9/06

[52] U.S. Cl. ..... 148/12.7 C; 148/414; 148/435

[58] Field of Search ..... 148/414, 435, 11.5 C, 148/12.7 C, 160; 420/485, 499

[56] References Cited

U.S. PATENT DOCUMENTS

| | | | |
|---|---|---|---|
| 2,275,188 | 3/1942 | Harrington | 148/12.7 C |
| 2,752,241 | 6/1956 | Berry | 420/485 |
| 3,832,241 | 8/1974 | Nesslage et al. | 148/160 |
| 4,007,039 | 2/1977 | Shapiro et al. | 148/160 |
| 4,036,642 | 7/1977 | Watson | 148/160 |

FOREIGN PATENT DOCUMENTS

| | | | |
|---|---|---|---|
| 1094937 | 12/1967 | United Kingdom | 420/485 |

OTHER PUBLICATIONS

Precipitation from Solid Solution, American Society for Metal, 1959, p. 367.

Mechanical Properties, vol. 6, 1977, p. 62.

Shibata, "The Equilibrium Diagram of the Complete Ternary System, Copper-Antimony-Nickel", Nippon Kinzoku Gakkai-Si, vol. 4, 1940, pp. 269-289.

Shibata, "The Equilibrium Diagram of the Complete Ternary System, Copper-Antimony-Nickel", Nippon Kinzoku Gakkai-Si, vol. 5, 1941, pp. 12-25.

*Metal Progress*, "Spinodal Cu-Ni-Sn Alloys are Strong and Superductile", Jul. 1974, pp. 46-50, by J. T Plewes.

*Metallurgical Transactions A*, "High-Strength Cu-Ni--Sn Alloys by Thermomechanical Processing", vol. 6A, Mar. 1975, pp. 537-544, by J. T. Plewes.

*Constitution of Binary Alloys*, McGraw-Hill Book Company, 1958, pp. 622-628.

*Primary Examiner*—Peter K. Skiff

*Attorney, Agent, or Firm*—Peter A. Businger

[57] ABSTRACT

Cu-Ni-Sb alloys have been discovered having a two-phase or multiphase state at low levels of antimony, and alloys in such state have high strength, high ductility, and high electrical conductivity. Tensile strengths in the range of 80,000-160,000 psi have been achieved, and electrical conductivity in the range of 30-65 percent of the conductivity of copper.

Alloys of the invention can be made by processing involving homogenizing, rapid cooling, cold working, and aging; for maximized electrical conductivity, dual combined steps of cold working and aging are beneficial.

7 Claims, 2 Drawing Figures

HIGH-STRENGTH, HIGH-CONDUCTIVITY COPPER ALLOYS

TECHNICAL FIELD

The invention is concerned with copper-based alloys.

BACKGROUND OF THE INVENTION

Copper-based alloys having high strength are of interest, e.g., in the manufacture of springs, relay elements, and wire connectors where, additionally, high electrical conductivity is desired. Considerable progress is represented in this respect by the development of Cu—Ni—Sn spinodal alloys by one of the present inventors; see, e.g., J. T. Plewes, "Spinodal Cu—Ni—Sn Alloys are Strong and Superductile", *Metal Progress*, July 1974, pp. 46–50 and J. T. Plewes, "High-Strength Cu—Ni—Sn Alloys by Thermomechanical Processing", *Metallurgical Transactions A*, Vol. 6A, March 1975, pp. 537–544. These alloys, in many instances, may advantageously replace customary Cu—Be or phosphor bronze alloys whose strength and formability are surpassed by the corresponding properties of suitably processed Cu—Ni—Sn alloys. (For example, a tensile strength exceeding 150,000 pounds per square inch in combination with area reduction to fracture exceeding 50 percent is obtainable in a Cu-9 weight percent Ni-6 weight percent Sn alloy.) However, while use of Cu—Ni—Sn alloys has led to significant savings, e.g., in the manufacture of wire connectors, recent increases in the price of tin have fostered interest in the development of further suitable alternatives.

Considered with respect to the invention were items concerning copper-antimony alloys, namely M. Hansen, *Constitution of Binary Alloys*, McGraw-Hill Book Company, 1958, pp,. 622–628; *Precipitation from Solid Solution*, American Society for Metals, 1959, page 367; and *Mechanical Properties*, Vol. 6, 1977, Trans-Tech Publications, page 62. Also considered were the papers by Nisaku Shibata, "The Equilibrium Diagram of the Complete Ternary System, Copper-Antimony-Nickel", *Nippon Kinzoku Gakkai-Si*, Vol. 4, 1940, pp. 269–289 and Vol. 5, 1941, pp. 12–25.

SUMMARY OF THE INVENTION

High strength, ductility, and conductivity are produced in copper alloys comprising Ni and Sb. Alloys of the invention have two-phase or multiphase structure and preferably comprise Ni in an amount which is greater than or equal to 0.1 weight percent and which is less than or equal to 30 weight percent. Antimony content preferably is less than or equal to 1.1 times Ni content and preferably is further limited as follows: Sb is present in a preferred amount which is at least 0.1 weight percent and which is less than or equal to an upper limit which depends on Ni content; specifically, at 6 weight percent Ni, Sb is preferably less than or equal to 6 weight percent, at 30 weight percent Ni, Sb is preferably less than or equal to 4.5 weight percent, and these two limits can be used to find upper limits for Sb by linear interpolation and extrapolation based on (Ni, Sb)-weight percent combinations of (6, 6) and (30, 4.5).

DETAILED DESCRIPTION

Figure 1:
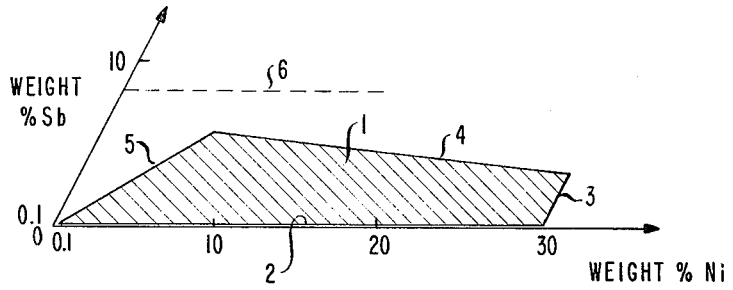
FIG. 1 graphically depicts an area in the ternary Cu—Ni—Sb diagram corresponding to preferred alloy compositions in accordance with the invention as more specifically defined above.

FIG. 1 shows a shaded region 1 corresponding to preferred alloy compositions in accordance with the invention. Region 1 is bounded by line segments 2, 3, 4, and 5 which represent preferred limits as follows: Segment 2 corresponds to antimony contents of 0.1 weight percent, segment 3 corresponds to nickel contents of 30 weight percent, segment 4 corresponds to (Ni, Sb)-combinations in weight percent which are linearly interpolated and extrapolated based on the combinations (6, 6) and (30, 4.5), and segment 5 corresponds to antimony contents which are equal to 1.1 times nickel contents. Broken line 6 is based on prior art belief according to which a Cu—Ni—Sb alloy would have to comprise at least approximately 8 weight percent antimony in order to have a two-phase or multiphase structure and that, accordingly, low-antimony alloys would be deficient in strength. By contrast, and in accordance with the invention, low-antimony Cu—Ni—Sb alloys are preferred for high strength, high ductility, and high electrical conductivity.

Desired combinations of strength, ductility, and electrical conductivity are realized in essentially ternary Cu—Ni—Sb alloys which preferably comprise at least 85 weight percent Cu, Ni, and Sb in combination. Alloys may further comprise impurities such as, e.g., Fe, Co, Zn, Al, Mn, Ti, Mg, Cr, Nb, In, Si, or Sn as may be expected to be present in commercial materials. Furthermore, there may be intentional additions, e.g., of free machining additives like Te, Se, or Pb. Oxygen is preferably kept below 100 ppm in the interest of minimizing the formation of refractory metal oxides.

Alloys of the invention are preferably processed, in the interest of high strength and ductility, by homogenizing, cold working, and aging. Such processing may be applied to a cast ingot which may be prepared by standard melt practice in which, e.g., a Ni—Sb intermetallic is added to a Cu—Ni melt at a temperature approximately 100 degrees C. higher than the melting point.

Homogenizing is effected when an alloy is in an essentially single-phase state; typical homogenizing temperatures are greater than or equal to 700 degrees C., and homogenizing time is chosen sufficiently long in view of the bulk of a body. More specific information regarding suitable homogenizing temperatures can be obtained from the diagram shown in FIG. 2, such temperatures being associated with points corresponding to a single phase which may be designated as alpha. Homogenizing is followed by rapid cooling such as, e.g., by water quenching. (Such quenching typically results in a cooling rate of at least 500 degrees C. per second.)

Figure 2:
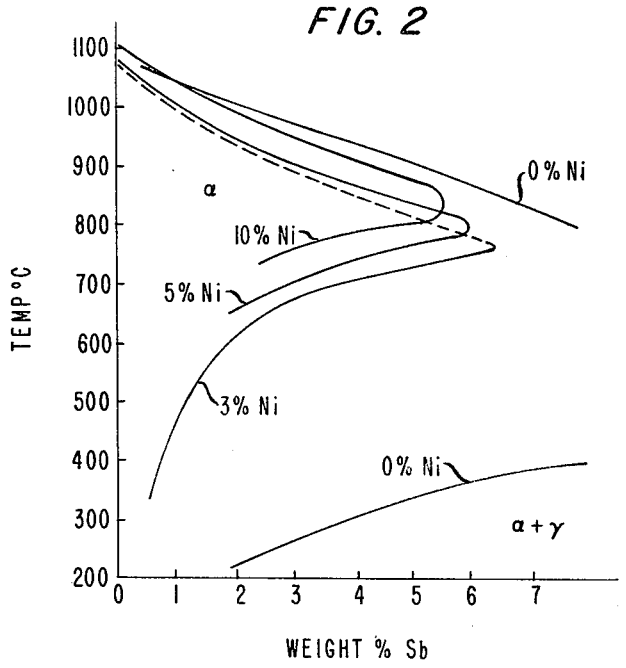
FIG. 2 graphically represents phase diagrams corresponding to Cu—Ni-Sb alloys in accordance with the invention comprising, respectively, 3 percent Ni, 5 percent Ni, and 10 percent Ni. For the sake of comparison FIG. 2 also shows phase boundaries for binary Cu—Sb alloys (0 percent Ni).

Cold working preferably results in deformation corresponding to an area reduction of 40 percent or greater, and preferred aging temperatures correspond to a two-phase or multiphase state which may be designated as alpha plus gamma. Preferred aging temperatures are in a general range of approximately 200–350 degrees C. and are illustrated in FIG. 2 as corresponding to alpha plus gamma. Specifically, FIG. 2 shows equilibrium phase boundary lines between a single phase alpha region and a two-phase or multiphase alpha-plus-gamma region of pseudo-binary (Cu,Ni)-Sb alloys. Ni contents of the Cu—Ni component are shown as a parameter having values 0, 3, 5, and 10 weight percent as based on the weight of the entire alloy. It can be seen from FIG. 2 that the presence of Ni in alloys of the invention significantly raises the phase boundary as compared with corresponding binary Cu—Sb alloys. Accordingly, and in contradistinction to prior art teaching, it has been discovered that the solubility of Sb in (Cu, Ni) decreases with increasing Ni contents, and such discovery of a two-phase or multiphase region at temperatures at which an alloy responds to aging heat treatment is used, in accordance with the invention, to produce high-strength alloys which retain significant ductility as contrasted with binary Cu—Sb alloys. Preferred alloys have a tensile strength of at least 80,000 psi.

When processing as described above is applied to alloys containing the same amount of nickel but different amounts of Sb, the antimony-rich alloy tends to have higher strength. Accordingly, for highest strength as expressed in terms of elastic limit, alloys rich in antimony are preferred.

For highest electrical conductivity and tensile strength, alloys are preferred in which Ni and Sb contents are equal or nearly equal in the sense that the ratio of weight percent Ni to weight percent Sb is in a preferred range of 0.9 to 1.1 and preferably 0.95 to 1.05. Further in the interest of highest electrical conductivity, processing as described above is preferably augmented by steps of cold working and aging carried out after homogenizing and prior to the steps of final cold working and aging as described above. Such prior cold working is preferably by an amount corresponding to an area reduction of 40 percent, and prior aging is at preferred temperatures in the range of 350–450 degrees C.

EXAMPLE 1

A cast metallic body consisting essentially of 5 weight percent Ni, 4 weight percent Sb, and remainder Cu was homogenized by heating at a temperature of approximately 775 degrees C., cold worked by drawing resulting in cross-sectional area reduction of approximately 88 percent, and aged by heating at a temperature of approximately 350 degrees C. for 30 minutes. Strength and ductility of the processed body were determined by measuring a 0.05-percent yield strength of 127,000 psi, a tensile strength of 145,000 psi, and an area reduction at fracture of 37 percent.

EXAMPLE 2

A cast metallic body consisting essentially of 5 weight percent Ni, 4 weight percent Sb, and remainder Cu was homogenized by heating at a temperature of approximately 775 degrees C., cold worked by drawing resulting in cross-sectional area reduction of approximately 96 percent, and aged by heating at a temperature of approximately 300 degrees C. for 25 minutes. Strength and ductility of the processed body were determined by measuring a 0.05-percent yield strength of 133,000 psi, a tensile strength of 163,000 psi, and an area reduction at fracture of 38 percent.

EXAMPLE 3

A cast metallic body consisting essentially of 5 weight percent Ni, 5 weight percent Sb, and remainder Cu was homogenized by heating at a temperature of approximately 775 degrees C., cold worked by drawing resulting in cross-sectional area reduction of approximately 56 percent, and aged by heating at a temperature of approximately 250 degrees C. for 70 minutes. Strength and ductility of the processed body were determined by measuring a 0.05-percent yield strength of 140,000 psi, a tensile strength of 148,000 psi, and an area reduction at fracture of 40 percent.

EXAMPLE 4

A cast metallic body consisting essentially of 2 weight percent Ni, 2 weight percent Sb, and remainder Cu was homogenized at a temperature of approximately 775 degrees C. Electrical conductivity of the homogenized alloy was approximately 19 percent of the conductivity of pure copper, and its tensile strength was approximately 40,000 psi. The alloy was further processed by cold drawing resulting in 90 percent area reduction, aging by heating at a temperature of approximately 400 degrees C. for 4 hours, cold drawing resulting in 75 percent area reduction, and aging by heating at a temperature of approximately 300 degrees C. for 5 hours. After such processing, the metallic body had a conductivity of 62 percent as compared with pure copper and a tensile strength of 105,000 psi.

EXAMPLE 5

A cast metallic body consisting essentially of 2.5 weight percent Ni, 2.5 weight percent Sb, and remainder Cu was homogenized at a temperature of approximately 775 degrees C. Electrical conductivity of the homogenized alloy was approximately 17 percent of the conductivity of pure copper. The homogenized alloy was further processed by cold drawing resulting in 90 percent area reduction, aging by heating at a temperature of approximately 400 degrees C. for 4 hours, cold drawing resulting in 75 percent area reduction, and aging by heating at a temperature of approximately 300 degrees C. for 5 hours. After such processing, the metallic body had a conductivity of 55 percent as compared with pure copper and a tensile strength of 116,000 psi.

EXAMPLE 6

A cast metallic body consisting essentially of 5 weight percent Ni, 5 weight percent Sb, and remainder Cu was homogenized at a temperature of approximately 775 degrees C. Electrical conductivity of the homogenized alloy was approximately 9 percent of the conductivity if pure copper. The homogenized alloy was further processed by cold drawing resulting in 90 percent area reduction, aging by heating at a temperature of approximately 350 degrees C. for 40 minutes, cold drawing resulting in 75 percent area reduction and aging by heating at a temperature of approximately 300 degrees C. for 5 hours. After such processing, the metallic body had a conductivity of 33 percent as compared with pure copper and a tensile strength of 134,000 psi.

What is claimed is:

1. Metallic body consisting essentially of a copper-nickel-antimony alloy, said alloy comprising nickel in an amount which is here designated as n and which is in the range of from 0.1 to 30 weight percent of said alloy, antimony in an amount which is less than or equal to 1.1 times Ni content, which is greater than or equal to 0.1 weight percent, which is less than or equal to 6 weight percent of said alloy when n is 6 weight percent, which is less than or equal to 4.5 weight percent of said alloy when n is 30 weight percent, and which is less than or equal to an amount which is obtained by linear interpolation or extrapolation based on 6 weight percent antimony at 6 weight percent nickel and 4.5 weight percent antimony at 30 weight percent nickel, said metallic body having a two-phase or multiphase structure, and said alloy having a tensile strength which is greater than or equal to 80,000 psi.

2. Metallic body of claim 1 in which said alloy comprises copper, nickel, and antimony in an amount which is greater than or equal to 85 weight percent of said alloy.

3. Metallic body of claim 1 in which the ratio of weight percent nickel to weight percent antimony is in the range of 0.9 to 1.1.

4. Method for making a metallic body in accordance with claim 1, said method comprising homogenizing, rapid cooling, cold working, and aging at a temperature corresponding to a two-phase or multiphase state of said alloy.

5. Method of claim 4 in which aging temperature is in a range of from 200 to 350 degrees C.

6. Method of claim 4 in which cold working is by an amount corresponding to an area reduction which is greater than or equal to 40 percent.

7. Method of claim 4 in which processing subsequent to said rapid cooling is by first cold working, first aging, second cold working, and second aging, said first aging being at a temperature in the range 350 to 450 degrees C, and said second aging being at a temperature in the range of 200–350 degrees C.

* * * * *